United States Patent [19]

Liebthal et al.

[11] Patent Number: 4,810,987

[45] Date of Patent: Mar. 7, 1989

[54] ONE PIECE MOLDED MAGNET ENCLOSURE

[76] Inventors: Siegfried G. V. Liebthal, 1013 Holly St., Alameda, Calif. 94501; Feather W. King, 165 Reiten Dr., Ashland, Oreg. 97520

[21] Appl. No.: 212,242

[22] Filed: Jun. 27, 1988

[51] Int. Cl.[4] ..... H01F 7/02

[52] U.S. Cl. ..... 335/302; 335/303

[58] Field of Search ..... 335/285, 295, 302, 303

[56] References Cited

U.S. PATENT DOCUMENTS

| | | | |
|---|---|---|---|
| 2,844,363 | 7/1958 | Clark | 335/302 X |
| 4,067,810 | 1/1978 | Sullivan | 335/303 X |
| 4,484,682 | 11/1984 | Crow | 335/303 X |

*Primary Examiner*—Harris George

*Attorney, Agent, or Firm*—Thomas M. Freiburger

[57] ABSTRACT

An enclosure for a rectangular magnet is formed by injection molding of five fixed sides in a rectangular box-like configuration, with a sixth side formed as a door on a plastic hinge. The door has a series of catches so that, with the magnet inserted in the enclosure, the door can be snapped shut permanently.

9 Claims, 1 Drawing Sheet

ONE PIECE MOLDED MAGNET ENCLOSURE

BACKGROUND OF THE INVENTION

The invention relates to a container or enclosure for magnets, generally of the type used to retain papers on a metal surface or for children's play, and to a magnet as enclosed in such a container.

Strong magnets have a number of uses, particularly around a household. In addition to popular usage on refrigerators for retaining notes, calendars and other papers, they can be used for erasing the content of magnetic recording tapes or discs and for children's games and entertainment.

It is generally desirable for the magnets to be coated or covered with some suitable plastic material, both for appearance and to soften the feel of the magnet in the hand. Such coating also prevents scratching of finished surfaces.

Magnets have been coated or enveloped or covered in a number of different ways. For example, see U.S. Pat. Nos. 4,303,062, 4,647,891 and 4,172,597. The first-listed patent describes a method for enveloping a magnet in a plastic coating, applied in a molten state. Such magnets are for use in the stomachs of cattle.

U.S. Pat. No. 4,647,891 discloses a cylindrical holder or jacket for a rod shaped magnet, wherein the magnet is inserted into the a central bore of the jacket, leaving one cylindrical end of the jacket open. A plug is then pushed into the opening and fused to the surrounding body of material to close the magnet container.

A bingo chip gathering magnetic device is disclosed in U.S. Pat. No. 4,172,597. In that device, in the form of a "wand" having a handle, a magnet is inserted into a five-sided box at the end of the wand. The open side of the box exposes the edge of the magnet, and bingo chips with magnetic metal are picked up using the exposed end of the magnet as well as the sides of the magnet box.

In addition, small, strong magnets of the type with which this invention is concerned have been jacketed by gluing them in five-sided closely fitting containers having one large side of the rectangular container open. A thin plastic or paper sticker was then applied to cover the magnet at the open side, also engaging the edges of the container, to complete the covering of the magnet.

Prior to the present invention, there existed no simple one-piece construction of a magnet jacket or enclosure into which a magnet could be assembled and contained more or less permanently, with all surfaces of the magnet covered and protected.

SUMMARY OF THE INVENTION

The present invention is directed to such a one-piece magnet container or jacket, formed by injection molding. A mold is so configured to form a relatively thin-walled five-sided container, which may be in the shape of a rectangular box, with an open door or flap extending on a plastic hinge from one edge, to form the sixth side. Latch protrusions are formed by the mold on the outer edge of the flap or door as well as on its side edges, and complementary shaped recesses or catching surfaces are formed just inside the three surfaces with which these catches will engage when the door is closed. When released from the mold, the plastic magnet container or jacket is formed with the door open obliquely somewhat beyond 90' from the closed position.

A strong magnet is closely fitted into the molded jacket, by sliding it into the preferably rectangular enclosure with the door open. The door is then closed and forced shut until the latches snap into the locked position. The door is virtually impossible to open after latching, without damage to the door or the sidewalls.

It is therefore among the objects of the present invention to provide an efficient plastic enclosure, for a household magnet, with the enclosure being integrally formed in one piece and with no further components to be assembled after the magnet is inserted. These and other objects, advantages and features of the invention will be apparent from the following description of a preferred embodiment, considered along with the accompanying drawings.

DESCRIPTION OF A PREFERRED EMBODIMENT

Figure 1:
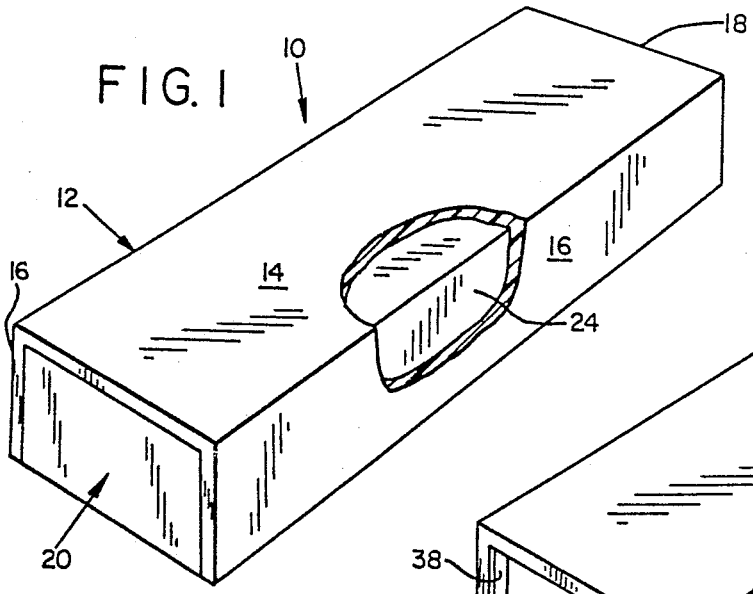
FIG. 1 is a perspective view showing a rectangular magnet jacket enclosing a small, strong magnet.

In the drawings, FIGS. 1 through 4 show a magnet enclosure or container 10 formed of a moldable plastic material which may be, for example, polypropylene or polyethylene. Preferably rectangular in shape, the magnet enclosure 10 has a body portion 12 formed of five fixed panels including four sides 14 and 16 which may be of larger and smaller dimensions, as illustrated, and an end panel 18.

Opposite the end panel 18 is a pivotal door or flap 20, integrally formed with the panels of the body 12, as a single injection molding, and connected preferably to a wider panel 14 by a plastic hinge 22.

Figure 4:
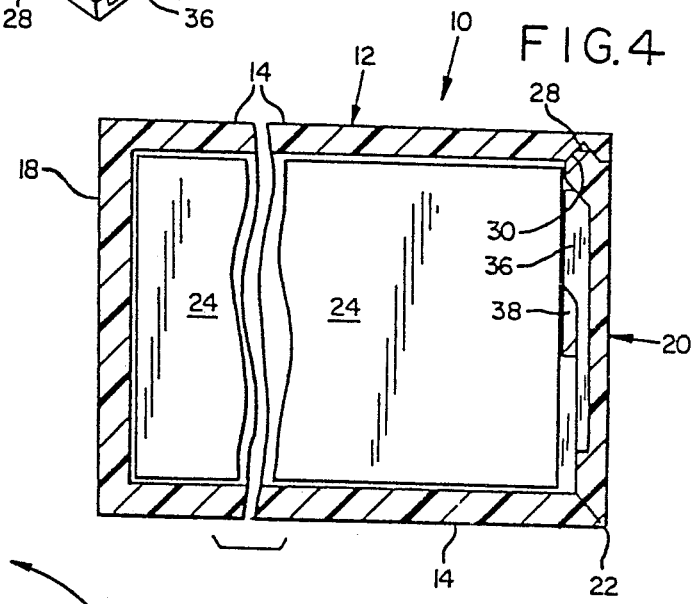
FIG. 4 is a view similar to FIG. 3, showing the door of the jacket in the closed, latched position.

FIGS. 1 and 4 show a magnet 24 contained inside the magnet container 10.

Figure 2:
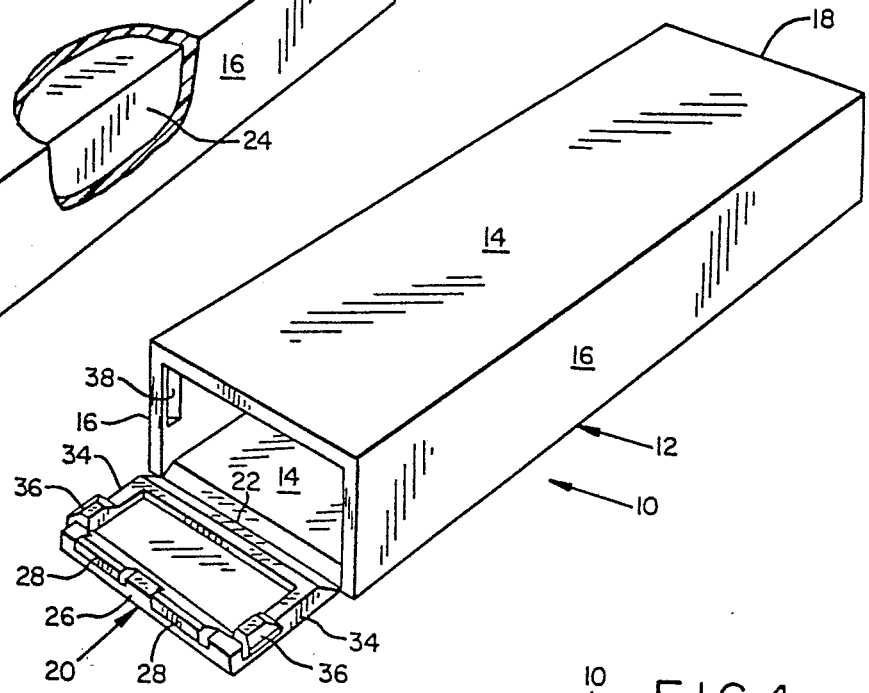
FIG. 2 is a view showing the magnet jacket or enclosure as molded, with an open door for insertion of the magnet.
Figure 3:
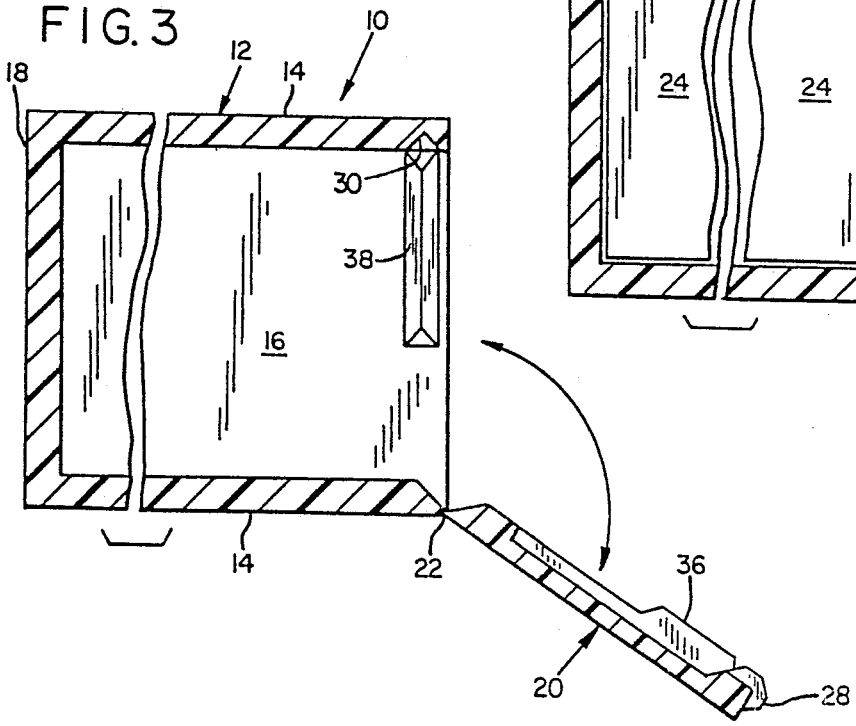
FIG. 3 is a detail view showing the preferred structure of latches which engage together upon closure of the door of the magnet jacket.

FIGS. 2, 3 and 4 show details of construction of the molded magnet container 10. As illustrated, the walls and door of the enclosure are relatively thin so that the magnet's effective strength at the outer surface of the enclosure is not weakened to an objectionable extent.

FIGS. 2 and 3 also show the configuration of latching devices for locking the door or flap 20 closed once the magnet has been inserted inside. The free end 26 of the door has at least one or preferably two outwardly extending protrusions 28, which may extend somewhat obliquely outwardly as illustrated. These coact with recesses 30 formed in the inner wall of the adjacent side, panel, near the outer end of the side panel, as illustrated. The recesses are complementarily shaped to the protrusions, so that the protrusions are snugly received and closed position of the door 20 (FIGS. 1 and 4) is well defined.

Similar latching devices preferably are included on the side edges 34 of the door 20. Thus, protrusions 36, preferably one on each side edge of the door, are included for engaging with side recesses 38 formed in the inside surfaces of the sidewalls 16, near their outer edges as illustrated.

In the injection molding of the magnet enclosure 10, the mold preferably is shaped to produce the open door 20 in a position approximately as shown in FIG. 3 (open about 135'), to enable the latching protrusions 28 and 36 and the plastic hinge 22 to be efficiently formed. A hydraulic core pull preferably is used to withdraw a core (not shown) which forms the interior surfaces of the magnet containing cavity of the enclosure. After the material has set the hot side (or cavity side) of the mold moves first and permits the part to expand at the location of the formed latch recesses 30 and 38, so the part can release from the core without permanent distortion.

The walls of the magnet enclosure are as thin as practicable, preferably on the order of about 1/16 inch or less in thickness. The broad side 14 having the door may be substantially thinner (about 0.025 to 0.032 inch) to provide a side with maximum magnetic attraction. The thickness at the plastic hinge 22 preferably is about 0.010 inch.

The magnet 24 preferably has a strength of at least about 750 gauss, and preferably 1000 gauss, which, in combination with an enclosure or jacket as described above, provides a strong attraction useful for holding a number of layers of paper on a refrigerator, for example. The magnet may be a Briggs and Stratton magnet, of a type in common use.

The preferred embodiment described herein is intended to illustrate the principles of the invention, but not to be limiting of the scope of the invention. Various other embodiments and variations to this embodiment will be apparent to those skilled in the art and may be made without departing from the scope of the invention as defined in the following claims.

We claim:

1. A one-piece molded plastic jacket for enclosing a magnet, comprising, a generally rectangular box-like body of plastic material, having five sides in box-like configuration and a hollow interior, with one open end, a door integrally formed with one of the sides and sized to fit in the open end when closed, with plastic hinge means connected to the door and said one side, for permitting swinging movement of the door about the edge of said one side for closing of the door, latch means associated with the door and box-like body, for latching and locking the door in the closed position after it has been closed following insertion of a magnet in the box-like body.

2. The magnet jacket device of claim 1, wherein the latch means comprises at least one protruding flange on the end of the door opposite the plastic hinge, and a protruding flange on each of the side edges of the door, and cooperating and complementarily shaped recesses in the inside surfaces of the adjacent walls of the box-like container, near the edges of the walls, in position to be engaged by the protrusions when the door is forced to the closed position to snap the protrusions in place.

3. The magnet jacket device of claim 1, wherein the sides of the jacket are less than about 1/16 inch in thickness.

4. The magnet jacket device of claim 1, wherein the thickness of the plastic material at the plastic hinge means is about 0.010 inch.

5. The magnet jacket device of claim 1, wherein at least one side of the jacket has a thickness no greater than about 0.032 inch.

6. A magnet encased within an enclosure, comprising, a relatively strong magnet of ferrous material, an enclosure closely surrounding the magnet, the enclosure being integrally formed of one piece of plastic material and including a multiple-sided body portion encasing the magnet and a hinged door integrally formed with the body portion and extending from the body portion from one edge in a plastic hinge, and the door being closed and latched over an opening large enough to receive the magnet in the enclosure, with latch means coacting between the door and the body portion adjacent to the opening, for locking the door in the closed position after the door has been closed.

7. The magnet device according to claim 6, wherein the latch means comprises a plurality of protrusions extending from edges of the door and cooperating recesses positioned in the body portion to receive the protrusions when the door is pushed and snapped into the closed position.

8. The magnet device of claim 7, wherein the protrusions of the latch means are positioned on the door so as to be hidden and inaccessible when the door is closed and latched, and the door and adjacent portions of the body portion presenting a substantially smooth exterior surface so that once closed and latched, the door is substantially impossible to reopen without damage to the enclosure.

9. The magnet device of claim 5, wherein the magnet has a strength of at least 750 gauss, and the enclosure has at least one wall having a thickness no greater than about 1/16 inch.

* * * * *